United States Patent [19]

Spector

[11] Patent Number: 4,489,939

[45] Date of Patent: Dec. 25, 1984

[54] MANIPULATING PLAY ELEMENTS IN LIQUID CELL

[76] Inventor: Donald Spector, 380 Mountain Rd., Union City, N.J. 07087

[21] Appl. No.: 139,341

[22] Filed: Apr. 11, 1980

[51] Int. Cl.[3] ..... A63F 7/00; A63F 9/14; A63H 23/08

[52] U.S. Cl. ..... 273/1 L; 272/8 N; 272/8 P; 273/86 R; 273/119 R; 273/121 R; 446/197; 446/198; 446/219

[58] Field of Search ..... 273/1 L, 1 R, 1 E, 1 M, 273/86 R, 142 A, 108–115; 272/8 P, 8 N; 46/92, 118

[56] References Cited

U.S. PATENT DOCUMENTS

| | | | |
|---|---|---|---|
| 2,072,723 | 3/1937 | Stitt | 273/142 A |
| 2,290,067 | 7/1942 | Parsons | 272/8 N X |
| 3,077,697 | 2/1963 | Fry | 273/1 L X |
| 3,309,088 | 3/1967 | Knott | 273/1 L X |
| 3,517,936 | 6/1970 | Hicks et al. | 273/115 |
| 3,738,036 | 6/1973 | Landsinger et al. | 272/8 P X |
| 4,083,631 | 4/1978 | Gugeler | 272/8 P X |

OTHER PUBLICATIONS

Tomy Catalog, p. 18, 2/76, The Wonderful Waterfuls.

*Primary Examiner*—Paul E. Shapiro
*Attorney, Agent, or Firm*—Michael Ebert

[57] ABSTRACT

A game in which play elements are immersed in liquid within a transparent cell contained in a cartridge insertable in an optical viewer or projector. The play elements have a specific gravity which is either slightly higher or lower than that of the liquid whereby the elements normally sink to the bottom of the cell or rise to the top thereof. The cartridge is provided with an external actuator which when manipulated by a player causes the play elements to move towards targets or other goals, this activity being viewable by the player on a screen.

3 Claims, 10 Drawing Figures

Fig. 1.
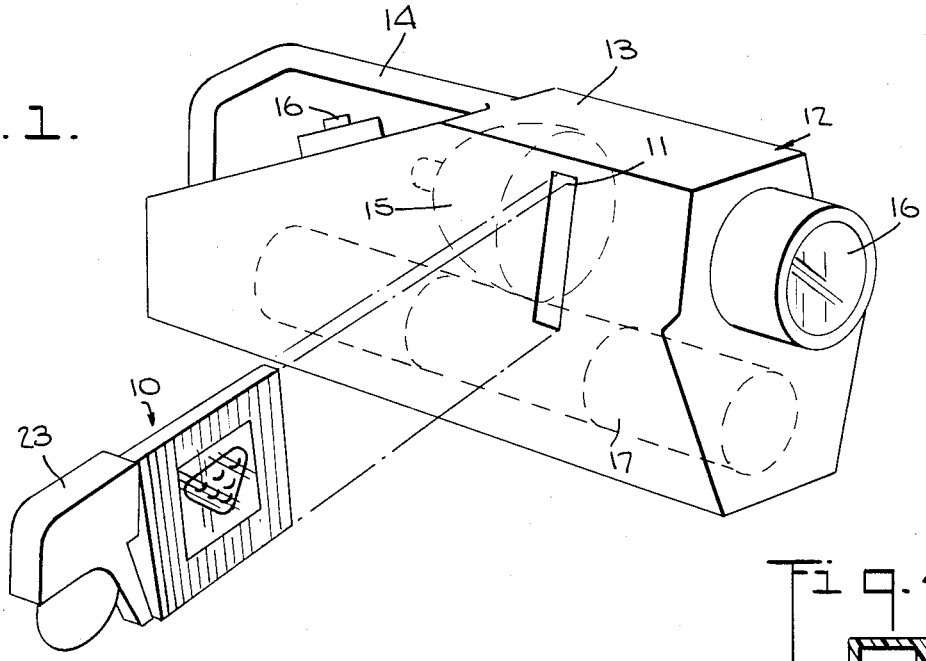
Fig. 2.
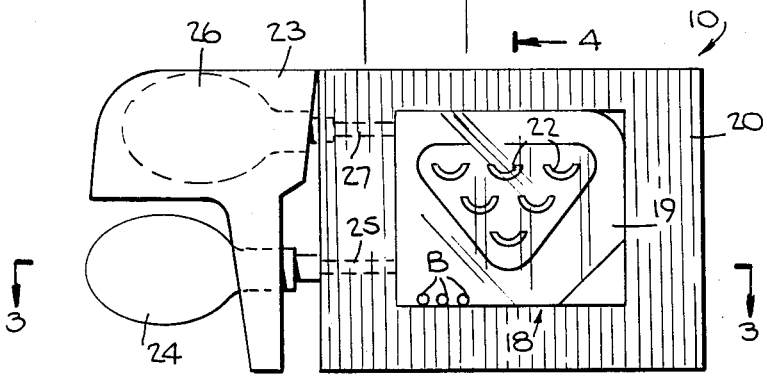
Fig. 3.
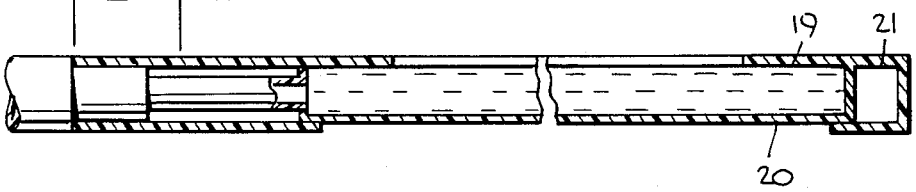
Fig. 4.
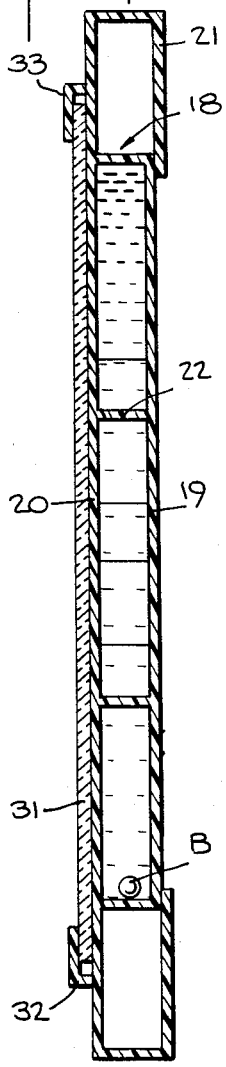
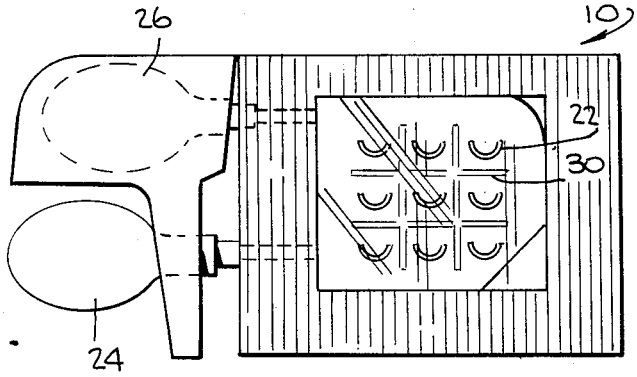
Fig. 6.

MANIPULATING PLAY ELEMENTS IN LIQUID CELL

BACKGROUND OF INVENTION

This invention relates generally to toys or games in which play elements immersed in liquid within a transparent cell are manipulated by external actuators, and more particularly to a cell of this type contained in a cartridge insertable in an optical viewer or projector whereby the play activity may be viewed on a screen.

U.S. Pat. No. 4,132,141 discloses a toy formed of a transparent enclosure containing a liquid bath. Immersed therein are play elements whose specific gravity is greater than that of the liquid, as a result of which the elements normally sink to the bottom of the enclosure. Arranged at fixed sites within the enclosure are targets for capturing the play elements. Thus when the elements are in the form of rings, the targets therefor may take the form of spikes. External to the enclosure and communicating therewith is a pump which when actuated by the player injects liquid into the enclosure to generate currents therein causing the play elements to rise toward the targets. In this way, the player is able to manipulate the play elements and direct them toward the targets.

Operating in a similar fashion is the toy disclosed in U.S. Pat. No. 2,779,134 in which a pressure-responsive fish-like element immersed in a water-filled vessel is caused to dive toward a target. This is accomplished by means of an air pump which when squeezed by the operator acts to increase the pressure within the liquid to cause the fish to dive. In U.S. Pat. No. 459,868, a play element of slightly greater specific gravity than that of liquid is shifted toward a target by agitating the liquid.

Water toys of the above-described prior art type have limited play value, for the game pattern is predetermined by the nature of the play elements and the targets employed therein. The typical player quickly acquires the necessary skill to play the game successfully, and then loses interest therein; for beyond this point the game is repetitious and tedious.

SUMMARY OF INVENTION

In view of the foregoing, the main object of this invention is to provide a water toy in the form of a replaceable cartridge containing a transparent cell filled with liquid having play elements immersed therein which are manipulated from an external actuator, the cartridge being insertable in an optical projector or viewer for presentation of the play activity on a screen.

A significant advantage of the invention is that by supplying a player with a set of cartridges each having a different game pattern, the player's interest is sustained; for when he has exhausted the possibilities of a given game, he may switch to another cartridge.

Also an object of this invention is to provide a cartridge-type water game in which the play elements therein are compressible and have a normal specific gravity slightly lower than that of the liquid whereby the elements normally tend to float on the liquid, whereby when subjected to pressure, the elements sink in the liquid. This arrangement is of particular advantage in the context of optical projectors which invert the image cast on the screen; for then the play elements, even though they move downwardly when manipulated, appear on the screen to move upwardly.

Yet another object of the invention is to provide a cartridge containing a transparent cell and adapted to accommodate a slide producing a background for the game pattern.

Briefly stated, these objects are attained in a game in accordance with the invention in which play elements are immersed in liquid within a transparent cell contained in a cartridge insertable in an optical viewer or projector. The play elements have a specific gravity which is either slightly higher or lower than that of the liquid whereby the elements normally sink to the bottom of the cell or rise to the top thereof. The cartridge is provided with an external actuator which when manipulated causes the play elements to move from their normal position toward targets or other goals, this being viewable by the player on a screen.

OUTLINE OF DRAWINGS

For a better understanding of the invention as well as other objects and further features thereof, reference is made to the following detailed description to be read in conjunction with the accompanying drawings, wherein:

FIG. 1 shows, in perspective, a cartridge in accordance with the invention in the process of being inserted in an optical projector;

FIG. 2 is an elevational view of the cartridge;

FIG. 3 is a longitudinal section taken through the cartridge in the plane indicated by lines 3—3 in FIG. 2;

FIG. 4 is a transverse section taken through the cartridge in the plane indicated by line 4—4 in FIG. 2;

FIG. 6 is an elevation of a modified form of cartridge;

DESCRIPTION OF INVENTION

Figures 5, 7:
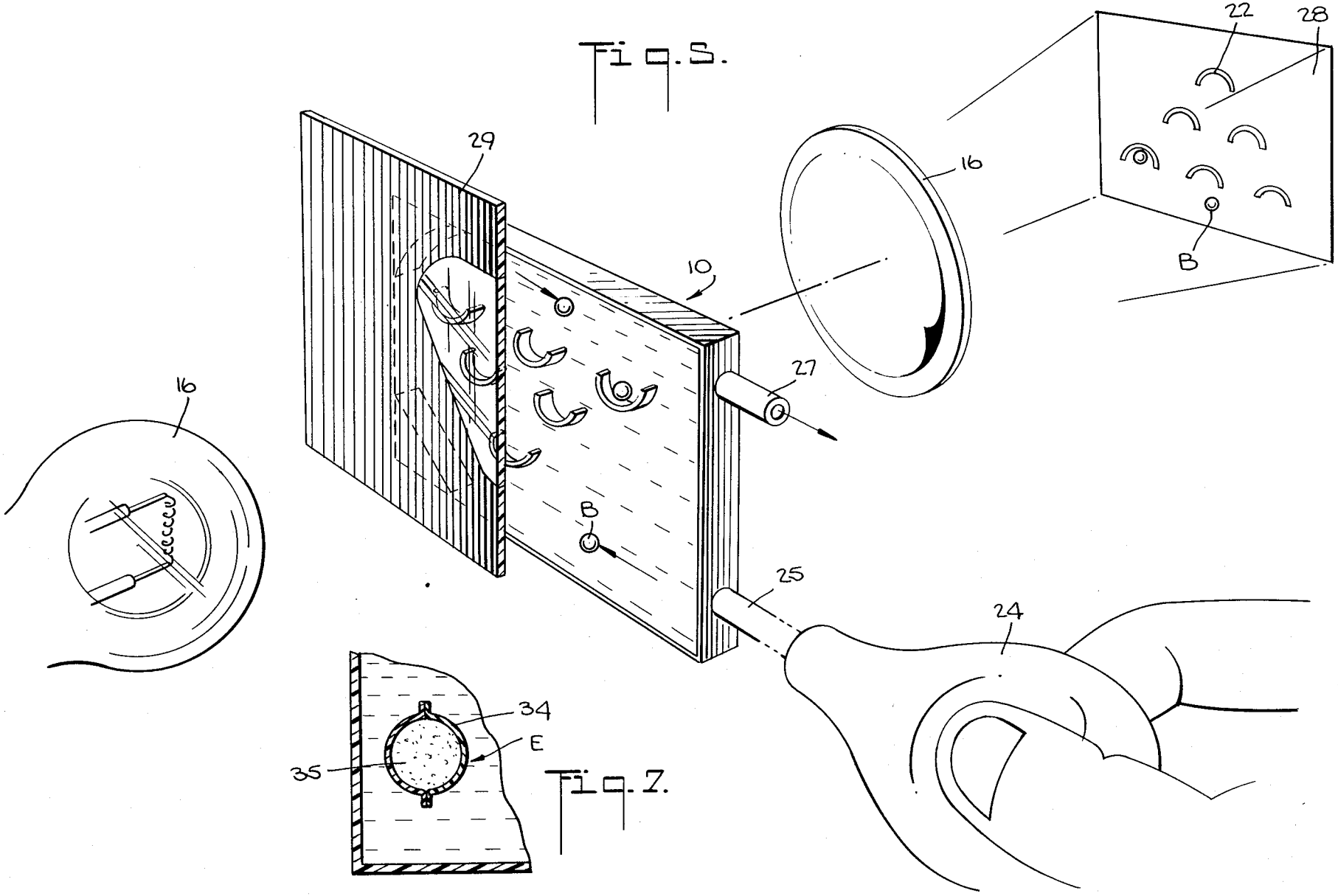
FIG. 5 is a perspective indicating the relationship between the cartridge, the components of the projector and the screen onto which an image of the cartridge cell is cast.
FIG. 7 is a section through a modified form of play element.

Referring now to FIG. 1, there is shown a water game cartridge in accordance with the invention, generally designated by numeral 10. The cartridge is insertable into the slot 11 of an otherwise conventional optical projector 12 having a casing 13 and a handle 14. The projector further includes a lamp 15 energized through a control switch 16 by batteries 17. When cartridge 10 is inserted in slot 11, it is then interposed between lamp 13 and a projection lens barrel 16, whereby an image of the game pattern incorporated in the cartridge cell is cast onto a remote screen, the image being focused thereon by rotating the lens barrel.

Cartridge 10, as shown in FIGS. 2, 3 and 4, contains a transparent cell, generally designated by reference numeral 18 formed of glass or acrylic material and having parallel front and rear walls 19 and 20, the cell being mounted within a rectangular frame 21. Cell 18 is filled with liquid and contains play elements B. These take the form of small plastic balls whose specific gravity is slightly greater than that of the liquid so that while the balls normally sink to the bottom of the cell, they are sensitive to liquid currents in the cell.

Mounted within the cell are targets 22 for receiving balls B, these being in the form of small troughs placed within a triangular zone. Associated with the cartridge is an actuator gun 23 having a trigger in the form of squeeze bulb 24 which communicates through a pipe 25 with the interior of cell 18 at a point adjacent the bottom thereof. Disposed within the gun housing is a storage bulb 26 which communicates with the cell interior through a pipe 27 at a point adjacent the top thereof.

Trigger bulb 24 is filled with liquid; and when it is squeezed by a player, the resultant jet stream of liquid impinges on balls 21 and causes agitation thereof, the balls moving in various paths toward the top of the cell and then dropping, in some instances, into the trough-like targets 22. Since the cell is filled with liquid, when trigger bulb 24 is squeezed to force additional liquid into the cell, this acts to displace liquid therefrom into storage bulb 26. When trigger bulb 24 is released, the negative pressure then produced sucks liquid from the cell into this bulb and thereby draws liquid from storage bulb 26 into the cell. By repeated and controlled squeezing actions, the player can manipulate the balls until all of them fall within targets.

Since the balls and targets are opaque, whereas the cell and the liquid therein are clear, cartridge 10 functions effectively as a transparency whose image pattern as defined by opaque elements is projected onto the screen. Thus, as shown in FIG. 5, the player, as he operates the actuator, sees the movement of balls B relative to the targets on a remote screen 28. In a conventional slide projector the lens acts to optically invert the projected image; hence the relationship of the balls to the targets is seen upside down. Also, in FIG. 5 it will be seen that the projector is provided with a light diffusion plate 29 so that light from source 16 is dispersed across the cartridge to uniformly illuminate the projected image.

In some instances, it may be desirable to provide a background for the game being played. Thus if cartridge 10, as shown in FIG. 6, has its targets arranged in a uniform array so that each lies within a square of a tick-tac-toe grid 30 formed by two vertical and two horizontal lines, this grid can be ruled or otherwise formed on a slide plate 31. This slide plate, as shown in FIG. 4, is received behind wall 20 of the cell and is supported by channel pieces 32 and 33 on frame 21. Obviously, other background patterns may be formed on slide 31, depending on the nature of the game. Thus each cartridge is usable in conjunction with a choice of slides to play various games.

As pointed out previously, because of optical inversion, the balls B, which normally sink to the bottom of the liquid cell and are propelled upwardly by the actuator toward targets, are actually seen on the screen as normally being at the top thereof to be propelled downwardly by actuation. In order, therefore, to have a seemingly erect image on the screen, use can be made, as shown in FIG. 7 of play elements E which have a specific gravity slightly lower than that of the liquid and hence normally rise on the liquid surface and appear at the top of the cell. A preferred form of play element E makes use of a sealed envelope 34 of plastic film material filled with a compressible sponge 35 or pad of flexible foam material.

To operate play element E, use is made of a single squeeze bulb 24, with no storage bulb such as bulb 26 in FIG. 2. Hence when bulb 24 is squeezed, it subjects the liquid in the cell to pressure, which pressure is exerted on compressible play element E to reduce its volume and hence its buoyancy, so that now the element tends to sink toward the bottom. But since the image projected on the screen is optically inverted, the play element appears to rise as the actuator is operated, rather than to fall.

Figure 8:
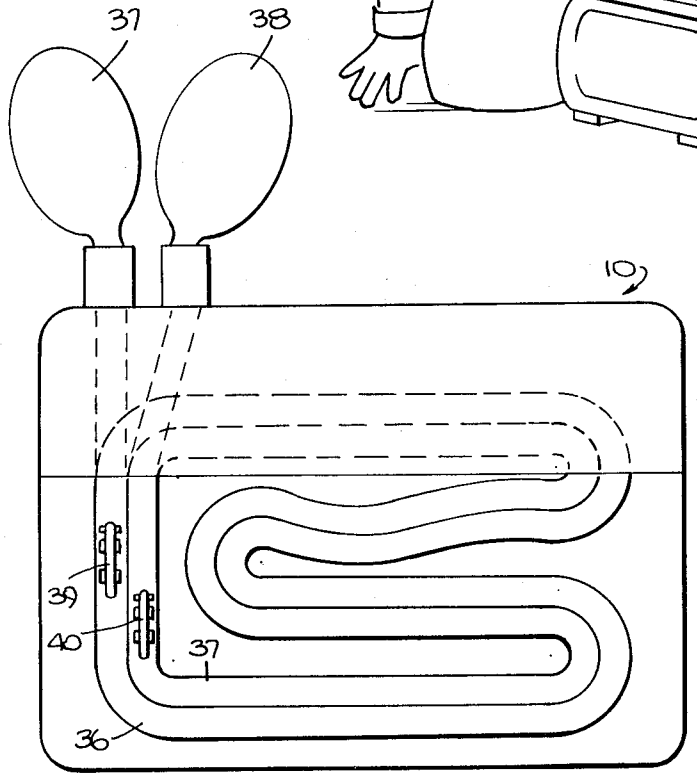
FIG. 8 shows another version of a cartridge in accordance with the invention.

Referring now to FIG. 8, there is shown still another version of a cartridge 10 where instead of a liquid filled cell, use is made of two liquid-filled tracks 36 and 37 of transparent tubing which run in parallel patterns and are coupled to respective external squeeze bulbs 37 and 38. Riding within tracks 36 and 37 are play elements 39 and 40 which are in the form of miniature missiles that are propelled along these tracks by squeezing the bulbs to inject therein a liquid stream.

Figure 9:
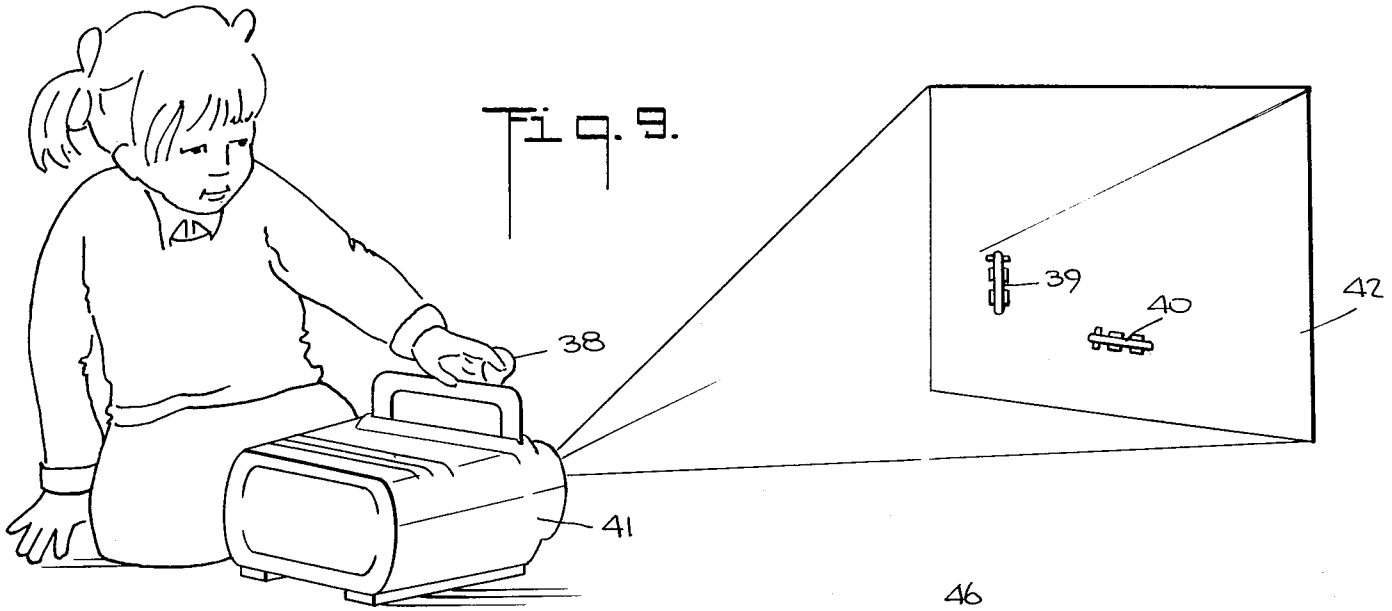
FIG. 9 shows how a cartridge of the type shown in FIG. 8 is projected.

Bulbs 37 and 38 are disposed above cartridge 10, the cartridge projector 41 for this cartridge being shown in FIG. 9. The projector has its slot at the upper end thereof, so that when the cartridge is inserted therein, bulbs 37 and 38 extend upwardly. By this arrangement, two players may compete by squeezing bulbs 37 and 38, the aim of the game being to race missiles 39 and 40 toward a finish line, as seen on screen 42.

Figure 10:
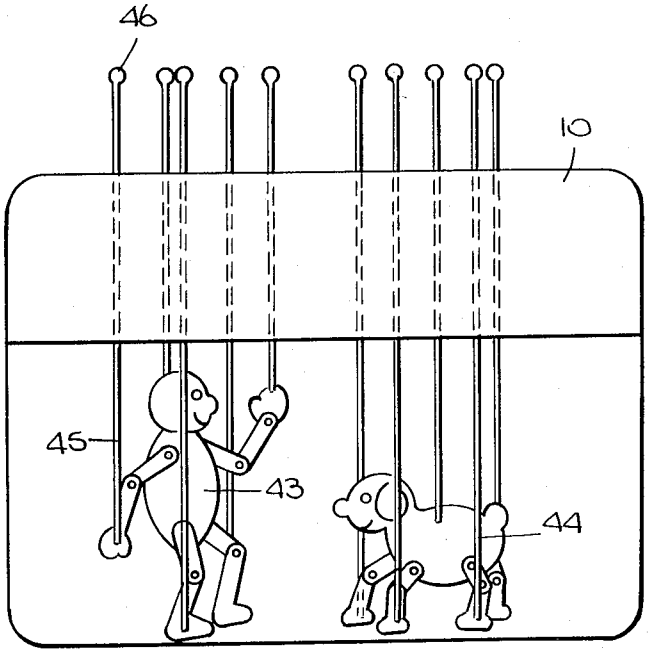
FIG. 10 shows still another embodiment of a cartridge.

Since whatever activity takes place within the liquid filled cartridge is projected in an enlarged scale on a screen, one can, as shown in FIG. 10, provide a cartridge 10 having marionettes 43 and 44 disposed therein whose legs and arms are linked by thin shanks 45 to external handles which a player can manipulate to animate the figures which are viewable on the screen.

While there has been shown and described a preferred embodiment of manipulating play elements in liquid cell in accordance with the invention, it will be appreciated that many changes and modifications may be made therein without, however, departing from the essential spirit thereof. Thus instead of a projector with an external screen, use may be made of an optical viewer which incorporates a screen as well as a slot to receive the cartridge.

I claim:

1. A play cartridge in combination with a conventional optical projector or viewer having a slot normally intended to receive a slide, said cartridge being insertable into the slot to provide images on a screen which are manipulatable by the player, said projector including a light source and a projecting lens which produces an inverted image of the cartridge interposed between the source and lens, said cartridge comprising:

A. a liquid-filled cell formed of transparent material and having parallel front and rear walls through which light from said source is transmitted, said cell being mounted within a rectangular frame;

B. opaque play elements disposed in said cell formed by objects whose specific gravity is less than that of the liquid whereby the objects normally rise to the top of the cell; and C. an external actuator supported on the frame and operable by a player to animate said play elements by propelling them toward the bottom of the cell, the play activity being viewable on said screen, where the objects, because of the inversion, appear to be moving upon actuation from the bottom to the top of the cell, and D. fixed targets disposed in said cell to capture said propelled play elements.

2. A play cartridge as set forth in claim 1, further including a slide plate insertable behind the rear wall of said cell and having a pattern thereon to provide a background for the play activity.

3. A play cartridge as set forth in claim 1, wherein said play elements are formed by a sealed envelope of film material enclosing a compressible pad, said cell being filled with liquid which is compressed by said actuator to cause said elements to compress and sink in the liquid.

* * * * *